United States Patent [19]

Strok

[11] Patent Number: 4,961,020

[45] Date of Patent: Oct. 2, 1990

[54] SODIUM VAPOR LAMP FOR SONIC PULSE OPERATION

[75] Inventor: Jack M. Strok, Garrettsville, Ohio

[73] Assignee: General Electric Company, Schenectady, N.Y.

[21] Appl. No.: 318,275

[22] Filed: Mar. 3, 1989

[51] Int. Cl.[5] ..... H01J 17/24

[52] U.S. Cl. ..... 313/025; 313/550

[58] Field of Search ..... 313/25, 549, 550, 556, 313/558, 562

[56] References Cited

U.S. PATENT DOCUMENTS 3,248,590 1/1966 Schmidt ..... 313/184
3,806,748 4/1974 Cohen et al. ..... 313/550 X
4,061,939 12/1977 Strok, Jr. ..... 313/25
4,137,484 1/1979 Osteen ..... 313/209 R
4,361,782 11/1982 Reiling ..... 313/25 X

*Primary Examiner*—Sandra L. O'Shea
*Attorney, Agent, or Firm*—John P. McMahon; Stanley C. Corwin; Fred Jacob

[57] ABSTRACT

An improved high pressure sodium vapor lamp construction is provided for operation on sonic frequency pulses without excessive acoustic noise. The novel jacketed lamp construction employs non-magnetostrictive metal for the frame employed to suspend a ceramic arc tube within the outer jacket in combination with a particular orientation or placement for ring getter elements located within said outer envelope. Various lamp constructions embodying such improvement are disclosed to enable relatively noise free lamp operation.

22 Claims, 3 Drawing Sheets

Fig. 1
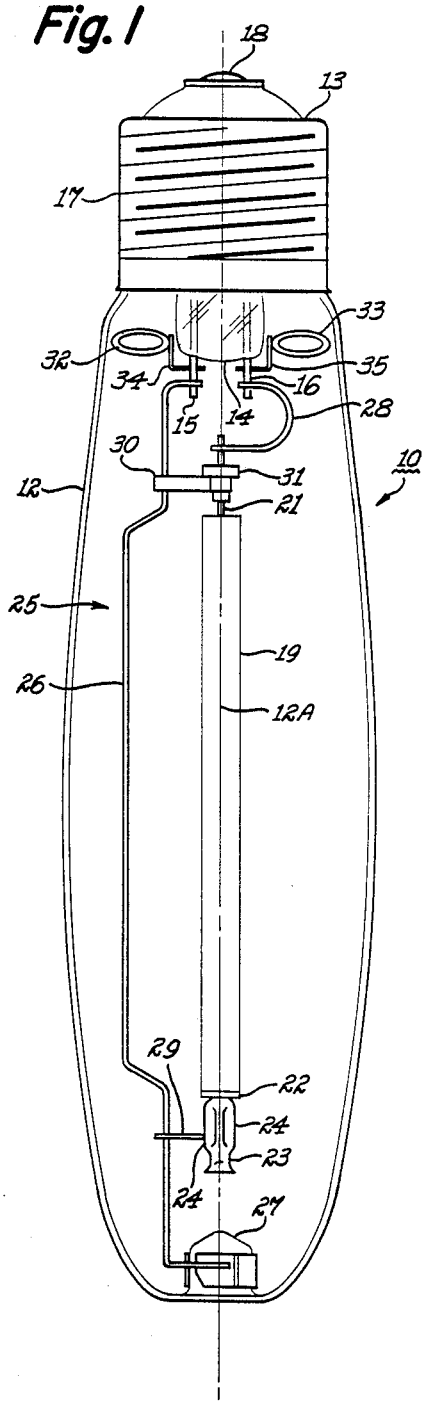
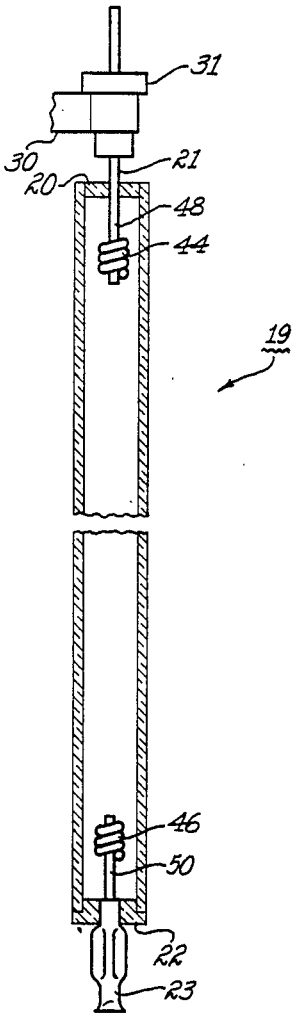
Fig. 2

Fig. 3
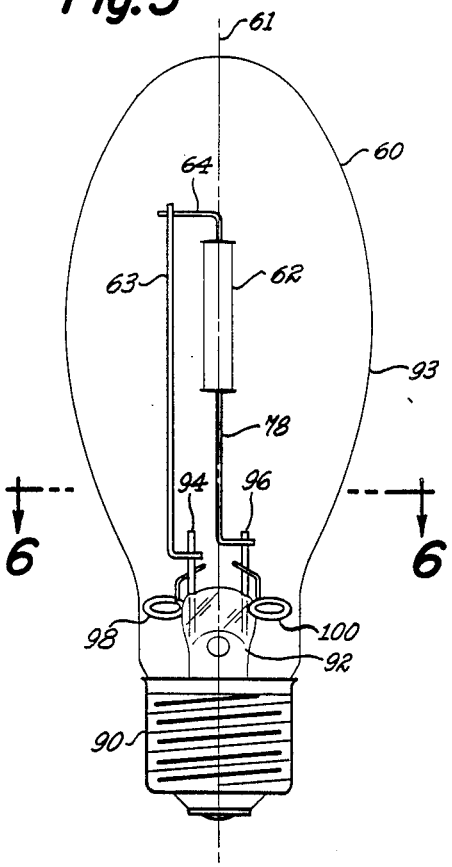
Fig. 4
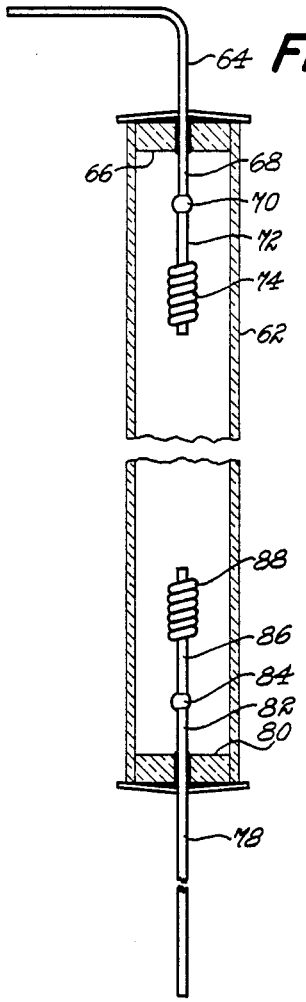
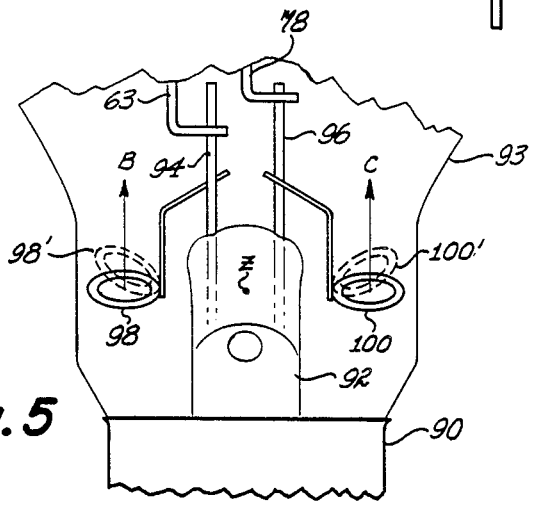
Fig. 5

SODIUM VAPOR LAMP FOR SONIC PULSE OPERATION

BACKGROUND OF THE INVENTION

This invention relates generally to a high pressure sodium vapor lamp construction for operation on sonic frequency pulses and more particularly to an improved structural configuration in said type lamp enabling operation without excessive acoustic noise.

High pressure sodium vapor lamps are now well known and widely used for street, roadway and area lighting applications. The basic lamp type is described in U.S. Pat. No. 3,248,590 issued to Schmidt in 1966 and generally comprises an outer vitreous envelope or jacket of glass within which is mounted a slender tubular ceramic arc tube. The ceramic envelope is made of a light transmissive refractory oxide material resistant to sodium at high temperatures, suitably high density polycrystalline alumina or synthetic sapphire. The filling comprises sodium along with a rare gas to facilitate starting, and mercury is generally included for improved operating efficiency. The ends of the alumina tube are sealed by suitable closure members affording connection to the electrodes. The outer envelope is generally provided at one end with a screw base having shell and eyelet terminals to which electrodes of the arc tube are connected. The original high pressure sodium vapor lamps were conventionally operated on 60 cycle alternating current by means of ballasts to limit the current to that of the lamp rating. In such operation, the light generated by the discharge is due almost exclusively to the excitation of the sodium atom through the self-reversal and broadening of the sodium D lines at 590 nanometers. The lamp efficiency is high when operated in such manner, up to 130 lumens per watt depending upon lamp size but the color temperature is low from approximately 1900° to 2100° Kelvin. While colors of the objects being illuminated in all portions of the spectrum are recognizable, those at the "cool" end such as violets, blues and to some extent greens are muted or grayed down. As such, the lamps were not found particularly acceptable for indoor applications where critical color discrimination is required. More recently, however, the color temperature of high pressure sodium vapor lamps has been raised and their color rendition has been improved by employing pulse operation. The principle of such operation is described in U.S. Pat. No. 4,137,484 issued to Osteen and assigned to the assignee of the present invention. By utilizing pulse repetition rates in the sonic ranges from about 500 to 2000 Hertz and short duty cycles from about 10 to 30 percent, the color temperature has been increased from a common value of 2050° K. to as high as 2700° K. with substantially no reduction in the lamp efficacy, or even higher than 2700° K. at the price of some reduction in efficacy.

In still another U.S. Pat. No. 4,061,939 issued to Strok and also assigned to the present assignee there is disclosed a jacketed high pressure sodium vapor lamp construction which avoids the undesirable acoustic noise accompanying such sonic frequency pulse operation. More particularly, it is recognized therein that a troublesome audible noise problem is encountered at the pulse operating frequency since the ear is sensitive to an audio range extending from about 16 up to about 20,000 Hertz. Also recognized is that the noise problem is aggravated by the short duty cycle being employed which means an abrupt rise and fall in current at every pulse inducing higher frequency harmonics which may be even more penetrating to the human ear. To effect a noise reduction when such lamps are being operated in this manner, only non-magnetostrictive metals are employed for the major lamp component parts. For example, the ceramic arc tube is said to be constructed with electrode supporting end closures fabricated with non-magnetostrictive metals such as niobium or tantalum. Likewise, a conventional nickel-iron metal frame supporting said ceramic arc tube was found to be another noise source so that non-magnetostrictive titanium metal was substituted in the construction of said lamp parts. A still further reduction of magnetostrictive metals in said lamp construction is also therein disclosed whereby nickel wire inleads are replaced with titanium and copper conductors. Since titanium is further recognized therein to serve as a gettering agent, the customary practice of incorporating ring getter elements in the lamp construction can also be avoided.

Unfortunately a number of the above listed non-magnetostrictive metals for use as components in this type lamp construction are both scarce and expensive commodity items. Thus, titanium is expensive and the effective use of this and other bulk metal getters in the lamp construction frequently requires a careful vacuum heat treatment for outgassing. Ring getter elements employing a vaporizable barium substance, on the other hand, remain a most effective gettering agent for the common impurities found in lamp constructions including water vapor, oxygen, carbon dioxide and nitrogen. Typically, a barium material further containing aluminum and packed within a small circular metal channel ring emits a directional beam of barium atoms when it is simply subjected to dull red heating by a radio frequency induction coil and with the flashed material thereafter providing effective gettering action. It remains desirable, therefore, to retain use of such ring getter elements in this type lamp construction while still not subjecting the lamp to excessive acoustic noise.

Accordingly, one object of the present invention is to provide means for utilization of ring getter elements in a high pressure sodium vapor lamp being operated by sonic pulses while not causing said lamp to encounter excessive acoustic noise.

Another object of the present invention is to provide a particular combination of at least one ring getter element with other non-magnetostrictive structural components in this type lamp so as to achieve low noise sonic pulse operation.

Still another object of the present invention is to provide means whereby at least one ring getter element is physically positioned in this type lamp so as to avoid acoustic coupling during lamp operation.

These and other objects of the present invention will become more apparent from the more detailed description hereinafter provided.

SUMMARY OF THE INVENTION

It has now been discovered that a particular spatial orientation or physical location for a ring getter element when employed in a jacketed high pressure sodium vapor lamp construction can substantially avoid acoustic coupling thereof during sonic lamp operation. More particularly, it has been found that locating said lamp component in the press seal region of the outer lamp envelope or jacket while still further orienting said component in a particular manner with respect to the ceramic arc tube also contained therein provides an unexpected reduction in the mechanical acoustic coupling otherwise occurring between these lamp components. Since the noise results from electromagnetic coupling between the main pulse current loop established in the arc tube during lamp operation and the getter rings it becomes thereby possible to minimize the mechanical acoustic interaction therebetween with relative spatial orientation. Minimizing such coupling effect is achieved by maintaining the plane of the ring getter element substantially perpendicular to the plane of the main lamp current loop as explained hereinafter more fully in connection with the illustrated lamp embodiments. In providing low noise gettering action by such means, it also now becomes possible to eliminate bulk gettering metals in the lamp construction. Thus, titanium can be eliminated as a construction material for lamps of this type in favor of such other less expensive non-magnetostrictive metals such as non-magnetic stainless steel and the like. A more cost effective lamp manufacture can thereby be achieved without sacrificing the desired low noise characteristic of lamp operation.

Accordingly, there is generally provided in accordance with the present invention a jacketed high pressure sodium vapor lamp for operation at low noise levels on sonic pulses of short duty cycle comprising in combination: (a) an elongated light transmissive ceramic arc tube having conductive electrode supporting closures sealed to opposite ends and containing an ionizable filling including sodium, said electrodes and closures comprising only non-magnetostrictive metal, (b) an evacuated outer vitreous light transmitting envelope surrounding the arc tube, the outer envelope having a vitreous stem at one end including a press region through which extend a pair of inleads, at least one ring getter element including a vaporizable barium substance being physically supported near the inleads so that a line extending perpendicularly from the plane in which the inleads reside lies substantially perpendicular with respect to a line extending perpendicularly from the plane in which the ring getter element resides, and (c) a metal wire frame within the outer envelope physically supporting and making electrical connection to the arc tube. The frame comprises a long side rod extending from the inner portion of one inlead toward the other end of the outer envelope, and a shorter length of rod extending from the inner portion of the other inlead, both rods being of a non-magnetostrictive metal. The electrodes for such improved lamp construction can be formed with a refractory metal that is non-magnetostrictive such as tungsten or molybdenum and to further include having a coiled configuration which can still further contain an emission material such as dibarium calcium tungstate. The arc tube end closures can be formed with other non-magnetostrictive metals such as niobium or tantalum for sealing directly to the ceramic arc tube with a known vitreous seal glass composition. As hereinabove indicated, the ceramic arc tube can be formed with a polycrystalline alumina ceramic or synthetic sapphire while suitable barium compounds for the ring getter element are also well known.

Representative lamp embodiments hereinafter more fully described are suitable for operation in combination with a generator of electrical pulses across the electrodes, the generator producing rated power input, the pulses having rise rapid enough and a time short enough to produce, in addition to the light resulting from self-reversal and broadening of the sodium D lines, substantial light in the blue-green region of the visible spectrum, whereby the color temperature is increased and the lamp operation is achieved at low noise levels. The lamp constructions generally comprising (a) an elongated light-transmitting polycrystalline alumina arc tube having conductive electrode supporting closures sealed at opposite ends and containing an ionizable filling including sodium and mercury, the electrodes comprising a tungsten metal and closures including at least one ceramic plug element, (b) an evacuated outer light transmitting glass envelope surrounding the arc tube, the outer envelope having a vitreous stem at one end including a press region sealed to a conductive base member. The press region further including a pair of inleads extending vertically inward therefrom, at least one ring getter element including a flashable barium aluminum alloy being physically supported from the inleads so that a line extending perpendicularly from the plane in which the inleads reside lies substantially perpendicular with respect to a line extending perpendicularly from the plane in which the ring getter element resides. The lamp construction further comprises, (c) a metal wire frame within the glass envelope physically supporting and making electrical connection to the arc tube. The metal frame comprising a long side rod extending from the inner portion of one inlead toward the other end of the glass envelope, and a shorter length rod extending from the inner portion of the other inlead, both rods having a non-magnetostrictive metal composition. In one of said illustrated lamp constructions, the ceramic arc tube is closed at one end with a ceramic sealing plug through which extends a niobium wire while the opposite arc tube end is closed with a ceramic sealing plug through which extends a closed niobium tube. Such metal tube and ceramic electrode supporting structure serves as a storage reservoir for excess sodium and mercury being employed to operate the particular lamp. In the remaining lamp being illustrated, both electrode supporting structures closing the arc tube ends are formed with ceramic sealing plugs through which extend niobium wires, which are hermetically sealed at the arc tube ends with a known ceramic sealing frit. The metal wire frame suspending the arc tube in such lamp embodiments can be either totally supported by the lamp inleads or partially supported with a dimpled end provided in the lamp jacket. Still other known configurations for the metal frame suitable in the presently improved lamp construction include laterally extending straps securing the electrode supporting closures to the long side rod as well as a flexible metal strap enabling axial expansion and contraction of the suspended arc tube. For all of said illustrated frame member configurations, however, a non-magnetostrictive iron alloy such as non-magnetic stainless steel is preferred in order to lower the cost of lamp manufacture.

BRIEF DESCRIPTION OF THE DRAWINGS

FIG. 1 is a front elevation view of a high pressure sodium vapor discharge lamp according to the present invention.

FIG. 2 is an exposed sectional view, in a slightly enlarged manner, of the arc tube of FIG. 1 in accordance with one embodiment of the present invention.

FIG. 3 is a high pressure sodium vapor lamp partially broken away so as to show a double wire arc tube as employed in accordance with the present invention.

FIG. 4 is an exposed sectional view of the arc tube of the high pressure sodium vapor lamp of FIG. 3.

FIG. 5 is a sectional view taken through the base portion of the FIG. 3 lamp embodiment.

DETAILED DESCRIPTION OF THE PREFERRED EMBODIMENTS

Figure 6:
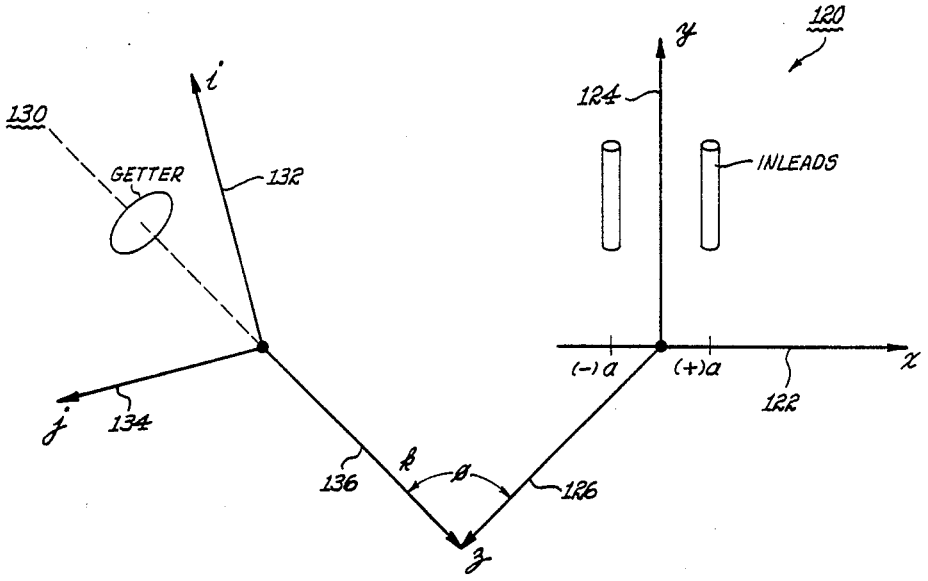
FIG. 6 illustrates one of the orientations of the present invention of the getter rings relative to the inleads of the lamps of FIGS. 1 and 3.

A high pressure sodium vapor lamp 10 embodying the present invention and corresponding to a conventional 250 watt size is illustrated in FIG. 1. A high pressure sodium vapor lamp generally comprises a vitreous outer envelope 12 which can be glass furnished with a standard mogul screw base 13 attached to the stem end which is shown uppermost in FIG. 1. A reentrant stem press 14 supports a pair of relatively heavy outer inlead conductors 15 and 16 extending through the stem 14 and having outer ends connected to the screw shell 17 and eyelets 18 of the base. The high pressure sodium vapor lamp 10 includes an inner envelope or arc tube 19 centrally located within the outer envelope 12. The arc tube 19 is comprised of a length of light-transmissive ceramic formed of a polycrystalline alumina ceramic which is translucent. The arc tube 19 contains a charge of vaporizable metals having a sodium partial pressure in a range of approximately 50–400 torr and a xenon gas in the range of approximately 10 to 400 torr. The upper end of the arc tube 19 is closed by an alumina ceramic sealing plug 20 through which extends hermetically a niobium inlead 21 which supports an upper electrode (shown more clearly in FIG. 2 to be subsequently described) within the arc tube 19. Similarly, the lower end of the arc tube 19 has a closure which comprises a ceramic sealing plug 22 through which extends a thin walled niobium tube 23. The ceramic sealing plugs 20 and 22 are described in greater detail in still further U.S. Pat. No. 4,065,691 issued to McVey and also assigned to the present assignee. The niobium tube 23 serves both as an inlead for arc tube 19 and as a reservoir for storing excess alkali metal and mercury contained within the arc tube 19. The shank of the lower electrode (shown in FIG. 2 to be described) of arc tube 19 projects into the reservoir tube 23 and is locked in place by crimping the niobium reservoir tube about the lower electrode at location 24 as shown in FIG. 1.

In accordance with the present invention, ceramic arc tube 19 is suspended within the outer glass envelope 12 along centerline 12A by a metal wire frame 25 which is secured to outer inlead conductor 15. Said frame construction is fabricated with non-magnetic steel wire, such as #316 composition, to include a long side rod 26 extending from inlead 15 to a dimpled protuberance 27 formed in the outer glass envelope and a shorter length curved rod 28 securing niobium inlead 21 to the remaining outer inlead 16. As can be further noted from the drawing, said frame construction further includes laterally extending metal straps 29 and 30 physically securing the arc tube 19 to frame 25 with an electrically insulative bushing 31 also being provided for strap 30 to avoid electrical shorting. A pair of barium ring getter elements 32 and 33 are also physically located within the outer glass envelope 12 according to the present invention. Thus, ring getter elements 32 and 33 are positioned adjacent the press region 14 of said outer envelope with both being preferably suspended by wire elements 34 and 35 from the respective outer inlead conductor 15 and 16. As still further preferred, both ring getter elements are physically displaced to the sides of the flattened press 14 so as to lie in a common horizontal plane oriented substantially perpendicular to a vertical plane intersecting inleads 15 and 16 as well as the arc tube 19 in a manner to be described.

FIG. 2 is a sectional view depicting the arc tube 19 of FIG. 1 in an enlarged manner. Tungsten electrodes 44 and 46 each include a low work function emissive material such as dibarium calcium tungstate which is formed into the coil windings wrapped about the electrode shanks 48 and 50 respectively, A further lamp embodiment of the present invention is a related double-wire inner arc tube 62 centrally located within a high pressure sodium vapor lamp 60 along its centerline 61 shown in FIG. 3 and supported, in part, by frame member 63. The depicted lamp construction 60 further includes suspension of the arc tube 62 with non-magnetostrictive metal frame wire 63 and inleads 64 and 78 which are physically and electrically connected to inleads 94 and 96 extending vertically from a stem press region 92 of the outer glass envelope 93. A pair of ring getter elements 98 and 100 are further secured to inleads 94 and 96 adjacent the stem press 92 of said outer envelope and in a manner to be more fully described in connection with FIG. 5. A conventional medium base 90 is also provided in the depicted lamp construction.

FIG. 4 shows the arc tube 62, preferably formed of a polycrystalline alumina, as having two oppositely located inleads 64 and 78 formed of niobium wire. The inlead 78 passes through and is supported by sealing plug 80. The inner portion of inlead 78 labeled 82 is connected to a shank 86 by a butt weld 84. The inner portion 82 of inlead 78 is a niobium feedthrough for arc tube 62. The shank 86 is formed of a tungsten metal and has electrode coils 88 having an emission mix between its turns. The emission mix can be dibarium calcium tungstate material. The inlead 64 passes through and is supported by a ceramic sealing plug 66. The inner portion of inlead 64 labeled 68 is connected to a shank 72 by a butt weld 70. The inner portion 68 of inlead 64 is a niobium feedthrough for arc tube 62. The shank 72 is formed of tungsten and has electrode coils 74 similar to the electrode coils 88.

FIG. 5 represents a vertical section 6—6 taken through the base portion of the lamp embodiment depicted in FIG. 3 so that a more detailed explanation can be provided for the required physical positioning of the ring getter elements within the outer envelope 93 according to the present invention. As above described, said base portion includes a standard medium screw base 90 having a reentrant stem press 92 through which extends vertically a pair of relatively heavy inlead conductors 94 and 96 providing sole physical support of the metal wire frame construction (elements 63, 64 and 78) suspending the arc tube member 62 in said FIG. 3 lamp embodiment. Said lamp embodiment further includes as also previously explained a pair of ring getter elements 98 and 100 located adjacent the press region and which are physically secured to the respective inleads 94 and 96. As still further previously explained, however, said ring getter elements are also required to be positioned in the outer lamp envelope 93 so as to minimize any acoustic coupling of these elements when the lamp is being operated. More particularly, said ring getter elements are further required to be physically positioned in the press region with an orientation which minimizes coupling to the pulsed magnetic flux field generated during arc tube operation. To better visualize a proper spatial orientation for the depicted ring getter elements (98 and 100), the present drawing includes a directional vector z extending perpendicularly or normal from the plane in which both inlead conductors 94 and 96 supporting the arc tube reside. There is further depicted in said drawing directional vectors B and C both extending perpendicularly or normal to the horizontal plane in which both ring getter elements reside. The orientation of the ring getter elements 98 and 100 relative to the inleads 94 and 96 of FIG. 3 along with the ring getters 32 and 33 relative to inleads 15 and 16 of FIG. 1 may be further described with reference to FIG. 6.

FIG. 6 shows an arrangement 120 of the inleads having an x-axis or directional vector x depicted by line 122 which corresponds to the transverse or horizontal axis of the lamp 60 (FIG. 3) or lamp 10 (FIG. 1), and a y axis or directional vector y depicted by line 124 which corresponds to the centerline or vertical axis of the lamp 60 (FIG. 3) or lamp 10 (FIG. 1). The plane of the inleads is defined by the x and y vectors. The direction vector z discussed with regard to FIG. 5 is also shown in FIG. 6 as line 126 in the z direction extending normally from the plane of the inleads.

FIG. 6 also shows an arrangement 130 of the getter rings having i (line 132), j (line 134) and k (line 136) vectors used to specify a suitable orthogonal coordinate system for the getter rings, where the plane of the getter elements is defined by the i and j vectors. The directional vector k (line 136) is shown in phantom to be extending normal or perpendicular from the plane of the getter elements. The directional relationship between the vectors k and z is indicated by the angle $\theta$.

The ring getter elements are desirably positioned adjacent or in the vicinity of the press region of the outer envelope so that a normal line (126) extending from the plane in which the inleads reside lies substantially perpendicular with respect to a normal line (136) extending from the plane in which the ring getter elements reside. The ring getters positioned to the sides of the press region of the inleads may be oriented in various upward and downward tilted manners because the k vector (line 136 of FIG. 6) of the ring getters remains perpendicular to the z axis of the inleads for all such orientations. A tilted spatial orientation of the depicted ring getter elements (98' and 100') is shown in FIG. 5 to illustrate an alternative acceptable arrangement still adhering to the herein defined orientation requirements for getter elements such as 98 and 100. On the other hand, it has also been found that locating the ring getter elements with respect to the inlead locations can result in failing to meet the defined orientation requirements. For example, a rotational displacement of the ring getter elements 98 and 100 to a position 90 degrees about the lamp centerline (12A of lamp 10 or 61 of lamp 60) in the present drawing would depart from the defined positioning requirements in so far as any tilting of the relocated elements is adopted. For such positioning, the angle $\theta$ between the directional vectors 126 and 136 is not perpendicular (90°) which creates undesired acoustic noise discussed in the "Background" section.

In operation, the orientation of the present invention of the getters 98 and 100 relative to the inleads 94 and 96 along with getters 32 and 33 relative to inleads 15 and 16 reduces the magnetic coupling between the getter rings and the main pulse current conducted by the inleads which would otherwise create a low level of acoustic noise. The coupling coefficient between the getter rings and main current loop is reduced by the described orientation, more particularly, by orienting the k vector which is normal to the plane i-j of the getters so as to be perpendicular to the z vector which is normal to the plane of the main lamp current loop developed by the current flow within inleads 94 and 96 or inleads 15 and 16.

It will be apparent from the foregoing description that broadly useful means have been provided to improve the operation of high pressure sodium vapor lamps with sonic frequency pulses. As above indicated, however, it is contemplated that numerous modifications can be made in the lamp constructions herein illustrated without departing from the spirit and scope of the present invention. For example, these lamps may employ still other already known basing constructions, arc tube support means, lamp outer envelope shapes and sizes, specialized ballasting circuits and still other lamp variations. Moreover, the present invention contemplates both higher lamp wattage ratings than illustrated such as 1000 watt and lower wattage ratings such as 15 watts. Consequently, it is intended to limit the present invention only by the scope of the appended claims.

What I claim as new and desire to secure by Letters Patent of the United States is:

1. A jacketed high pressure sodium vapor lamp for operation at low noise levels on sonic pulses of short duty cycle comprising in combination:

(a) an elongated light transmissive ceramic arc tube having conductive electrode supporting closures sealed to opposite ends and containing an ionizable filling including sodium, said electrodes and closures comprising only non-magnetrostrictive metal, (b) an evacuated outer vitreous light transmitting envelope surrounding the arc tube, the outer envelope having a vitreous stem at one end including a press region through which extends a pair of inleads, at least one ring getter element including a vaporizable barium substance being physically supported in the vicinity of the inleads so that a normal line extending from the plane in which the inleads reside lies substantially perpendicular with respect to a normal line extending from the plane in which the ring getter element resides, the orientation of said ring getter element relative to said inleads reducing the acoustic coupling therebetween, and (c) a metal wire frame within the outer envelope physically supporting and making electrical connection to the arc tube, the frame comprising a long side rod extending from the inner portion of one inlead toward the other end of the outer envelope, and a shorter length of rod extending from the inner portion of the other inlead, both rods being of a non-magnetostrictive metal.

2. The lamp of claim 1 wherein the arc tube closures are niobium.

3. The lamp of claim 1 whwerein the vaporizable barium substance is a barium compound.

4. The lamp of claim 1 wherein the arc tube is polycrystalline alumina.

5. The lamp of claim 1 wherein the ring getter elements are supported in a like manner from both inleads.

6. The lamp of claim 1 wherein the non-magnetostrictive metal rods have an iron alloy composition.

7. The lamp of claim 6 wherein the non-magnetostrictive metal rods are of a non-magnetic stainless steel material.

8. The lamp of claim 1 wherein the metal wire frame is entirely suspended by the inleads.

9. A jacketed high pressure sodium vapor lamp unit for operation at low noise levels on sonic pulses of short duty cycle, comprising:

(a) an elongated light-transmitting polycrystalline alumina arc tube having conductive electrode supporting closures sealed at opposite ends and containing an ionizable filling including sodium and mercury, the electrodes comprising a tungsten metal and the closures including at least one ceramic plug element, (b) an evacuated outer light transmitting glass envelope surrounding the arc tube, the outer envelope having a vitreous stem at one end including a press region sealed to a conductive base member, the press region further including a pair of inleads extending vertically inward therefrom, at least one ring getter element including a flashable barium aluminum alloy being physically supported from the inleads so that a normal line extending from the plane in which the inleads reside lies substantially perpendicular with respect to a normal line extending from the plane in which the ring getter element resides, the orientation of said ring getter relative to said inleads reducing the acoustic coupling therebetween, and (c) a metal wire frame within the glass envelope physically supporting and making electrical connections to the arc tube, the frame comprising a long side rod extending from the inner portion of one inlead toward the other end of the glass envelope, and a shorter length rod extending from the inner portion of the other inlead, both rods having a non-magnetostrictive metal composition.

10. The lamp unit of claim 9 wherein ring getter elements are supported in a like manner from both inleads.

11. The lamp unit of claim 9 wherein the tungsten electrodes have a coil configuration.

12. The lamp unit of claim 11 wherein one electrode further includes an emission material.

13. The lamp unit of claim 9 wherein the arc tube contains a rare gas fill.

14. The lamp unit of claim 9 wherein one electrode supporting closure has a tubular configuration affording a storage reservoir for excessive sodium and mercury.

15. The lamp unit of claim 9 wherein the electrode supporting closures are sealed to the arc tube with a vitreous seal glass composition.

16. The lamp unit of claim 9 wherein the non-magnetostrictive metal rods have an iron alloy composition.

17. The lamp unit of claim 16 wherein the non-magnetostrictive metal rods have a non-magnetic stainless steel composition.

18. The lamp unit of claim 9 wherein the metal wire frame is entirely suspended by the inleads.

19. The lamp unit of claim 9 wherein the glass envelope includes a dimple configuration opposite the base end to help support the metal wire frame.

20. The lamp unit of claim 9 wherein the metal wire frame further includes laterally extending metal straps securing both electrode supporting closures to the long side rod.

21. The lamp unit of claim 20 wherein the metal strap securing one electrode supporting closures to the long side rod is electrically insulated from one of the inleads.

22. The lamp unit of claim 9 wherein the metal wire frame further includes a flexible metal strap enabling axial expansion and contraction of the suspended arc tube.

* * * * *